US005364259A

United States Patent [19]

Matros et al.

[11] Patent Number: 5,364,259

[45] Date of Patent: Nov. 15, 1994

[54] PROCESS AND APPARATUS FOR GAS PHASE REACTION IN A REGENERATIVE INCINERATOR

[75] Inventors: Yurii S. Matros, St. Louis; David E. McCombs, Chesterfield, both of Mo.

[73] Assignee: Monsanto Enviro-Chem Systems, Inc., St. Louis, Mo.

[21] Appl. No.: 29,008

[22] Filed: Mar. 10, 1993

[51] Int. Cl.[5] ..... F23D 14/00

[52] U.S. Cl. ..... 431/5; 110/211; 110/212; 422/171; 422/178

[58] Field of Search ..... 431/5, 7, 170; 110/211, 110/212; 422/175, 171, 178; 432/181

[56] References Cited

U.S. PATENT DOCUMENTS

| | | | |
|---|---|---|---|
| 3,870,474 | 3/1975 | Houston | 23/277 |
| 3,895,918 | 7/1975 | Mueller et al. | 23/277 |
| 4,252,070 | 2/1981 | Benedick | 110/211 |
| 4,302,426 | 11/1981 | Benedick | 422/173 |
| 4,478,808 | 10/1984 | Matros et al. | 423/522 |
| 4,650,414 | 3/1987 | Grenfell | 431/5 |
| 4,834,962 | 5/1989 | Ludwig | 423/351 |
| 4,877,592 | 10/1989 | Matros et al. | 423/245 |
| 5,000,422 | 3/1991 | Houston | 251/306 |
| 5,016,547 | 5/1991 | Thomason | 110/211 |
| 5,145,652 | 9/1992 | Veser et al. | 422/175 X |
| 5,149,259 | 9/1992 | Greco | 431/5 |
| 5,229,071 | 7/1993 | Meo, III | 422/175 X |

FOREIGN PATENT DOCUMENTS

| | | |
|---|---|---|
| 0365262 | 10/1989 | European Pat. Off. . |
| 1478419 | 1/1975 | United Kingdom . |

OTHER PUBLICATIONS

"Swingtherm-The Best System for Control of Volatile Organic Compounds in Air".

Salem Industries, Inc., "Solutions." (no date).

The Regenerative Environmental Equipment Co., Inc. "Reeco RE-THERM, The Most Effective Energy Saving Air Pollution Control System in the World Today".

"Topsoe R-Catox Catalytic and Thermal Combustion." (no date).

*Primary Examiner*—Edward G. Favors

*Attorney, Agent, or Firm*—Senniger, Powers, Leavitt & Roedel

[57] ABSTRACT

An improved process and apparatus for the gas phase reaction of a feed gas mixture in a regenerative incinerator comprising a combustion zone in fluid communication with at least three separately-housed chambers. Each chamber contains a layer of solid heat exchange material, and is in selective fluid communication with an inlet manifold and an exhaust manifold such that each chamber is selectively operable in an intake mode and an exhaust mode. A layer of catalyst is disposed in each chamber such that catalytic reaction of the feed gas mixture occurs and the operating temperature of the combustion zone may be reduced.

15 Claims, 2 Drawing Sheets

PROCESS AND APPARATUS FOR GAS PHASE REACTION IN A REGENERATIVE INCINERATOR

SUMMARY OF THE INVENTION

This invention relates generally to gas phase reaction of feed gas mixtures in regenerative incinerators comprising at least three separately-housed chambers, and more specifically, to a process and apparatus for the catalytic, gas phase reaction of feed gas mixtures in such incinerators.

Incineration may be used to abate, by oxidation, the combustible, volatile organic compounds (VOCs) found in gaseous process emissions. Oxidation of organic components in the emission or feed gas is achieved in an incinerator by elevating the temperature of the gas above the ignition temperature of the components in the presence of oxygen using a heat source such as natural gas burners or electric heaters. Regenerative incinerators are characterized by "heat sinks", that is, layers of heat exchange material, which store the heat remaining in the reacted gas after incineration so that this heat may be used to increase the temperature of the feed gas and thereby reduce external fuel requirements.

Although regenerative incinerators may be configured in other ways, many of the incinerators in use comprise three or more separately-housed chambers, each containing a layer of heat exchange material. These chambers are in fluid communication with a combustion zone. In operation, the feed gas passes through one of the chambers where the temperature of the feed gas is elevated as it contacts the layer of heat exchange material which has previously been heated. The heated gas then enters the combustion zone where a natural gas burner or other heat source raises the temperature of the gas above the ignition temperature of the combustible components of the feed gas. After combustion, the hot, reacted gas exits the incinerator by passing through a different chamber, thereby transferring its heat to the layer of heat exchange material contained therein. Periodically, the flow of gas through the chambers of the incinerator is redirected such that a layer of heat exchange material alternately pre-heats the incoming feed gas when the corresponding chamber is operated in an intake mode or is pre-heated by the reacted gas leaving the combustion zone when the corresponding chamber is operated in an exhaust mode. The operation of a chamber in the intake mode followed by operation in the exhaust mode, or vice versa, constitutes a heat cycle.

After operating in the intake mode and prior to operating in the exhaust mode, the chambers of the incinerator may be purged of residual contaminated feed gas by passing clean air through the chamber which then flows to the combustion zone. Purging the chambers prevents unreacted feed gas from being discharged from the incinerator during the exhaust mode.

The high operating temperatures (e.g., 950°-1500° C.) that must be maintained in the combustion zone of a regenerative incinerator impose several liabilities on such a system. High operating temperatures require rigorous structural design, increased tolerances in the materials of construction and large amounts of heat exchange material which increase costs. High temperatures also produce nitrogen oxides which are then discharged from the incinerator as an atmospheric pollutant. Furthermore, the operation of a heat source in the combustion zone, such as burners or electric heaters, adds to operating costs. If a burner is used, the $CO_2$ content of the gas exiting the incinerator is increased. Finally, high operating temperatures often require regenerative incinerators to be operated with short heat cycle periods to prevent damage to the equipment caused by overheating and to reduce heat loss from the incinerator. Short heat cycle periods hasten equipment wear, including fatigue of metal process equipment caused by thermal expansion and contraction and valve failure resulting from the increased frequency of valve repositioning.

Among the objects of the invention, therefore, may be noted the provision of an improved process and apparatus for the gas phase reaction of a feed gas in a regenerative incinerator comprising a combustion zone in fluid communication with at least three separately-housed chambers, each containing a layer of heat exchange material; the provision of such a process and apparatus in which the operating temperature of the combustion zone may be reduced; the provision of such a process and apparatus in which operation of a heat source in the combustion zone may be reduced or eliminated; and the provision of such a process and apparatus in which the heat cycle period may be increased.

Briefly, therefore, the present invention is directed to a process for the gas phase reaction of a feed gas mixture in a regenerative incinerator comprising a combustion zone in fluid communication with at least three chambers. Each chamber has a separate housing, contains a layer of solid heat exchange material, and is in selective fluid communication with an inlet manifold and an exhaust manifold such that each chamber is selectively operable in an intake mode and an exhaust mode. The process of the invention is characterized in that a layer of catalyst material is disposed in each chamber such that catalytic reaction of the feed gas mixture occurs and the operating temperature of the combustion zone is below 850° C. The layer of catalyst material is disposed in each chamber such that when the chambers are being operated in the intake mode the feed gas mixture flowing through a chamber contacts heat exchange material before contacting the catalyst material.

The present invention is additionally directed to a regenerative incinerator for gas phase reaction of a feed gas mixture comprising a combustion zone in fluid communication with at least three chambers. Each chamber has a separate housing and contains a layer of solid heat exchange material. The chambers are in selective fluid communication with an inlet manifold and an exhaust manifold such that each chamber is selectively operable in an intake mode and an exhaust mode. The incinerator further comprises a layer of catalyst material disposed in each chamber.

BRIEF DESCRIPTION OF THE DRAWINGS

Corresponding reference numbers indicate corresponding parts throughout the specification.

DETAILED DESCRIPTION OF THE PREFERRED EMBODIMENTS

The present invention is characterized by a layer of solid catalyst material disposed in the chambers of a multi-chamber regenerative incinerator having three or more separately-housed chambers in fluid communication with a combustion zone. As the feed gas contacts the catalyst layer, the components in the feed gas are catalytically reacted (e.g., oxidized in the case of VOCs). The reaction of components in the feed gas occurs primarily in the catalyst layer rather than in the combustion zone. The activation energy required to catalytically react the components of the feed gas is significantly lower than the activation energy required for the gas phase reaction of the components in the combustion zone. Thus, the operating temperature of the combustion zone may be reduced and need only be high enough to maintain a gas temperature which ensures sufficient catalytic activity. Aside from the reduction in combustion zone operating temperature, other significant advantages are provided, including: reduced pressure drop across the incinerator because there will be less thermal expansion of the gas at the lower operating temperatures, reduction or elimination of the need to operate a heat source in the combustion zone which reduces energy requirements and longer heat cycle periods which reduces the mechanical problems associated with more frequent valve repositioning.

Various forms of solid catalyst material may be employed, including granular as well as monolithic honeycomb catalysts. If a granular catalyst is employed, the particles preferably have a nominal diameter of 2 mm to 5 cm. If a monolithic catalyst is employed, such catalyst is preferably of the form described by L. Hamann and P. Teiman in *Energie,* Vol. 36, No. 9, p. 23 (1986). The catalyst material employed should be capable of withstanding process temperatures and pressures. Desirably, most impurities will not chemically bond to the surface of the catalyst material employed. Typical noble metal catalysts such as platinum and paladium offer low operating temperature and may be particularly preferred in some circumstances. Metal oxide catalysts can be used in selected applications.

The amount of catalyst material disposed in a single chamber may vary, but is preferably an amount such that the ratio of the catalyst volume ($V_c$) to the volumetric flowrate of incoming feed gas (G) through the chamber when operating in the intake mode is between about 0.05 and about 2 seconds. Furthermore, the ratio of the volume of heat exchange material ($V_{in}$) in a chamber to $V_c$ is preferably between about 1 and about 50.

Figure 1:
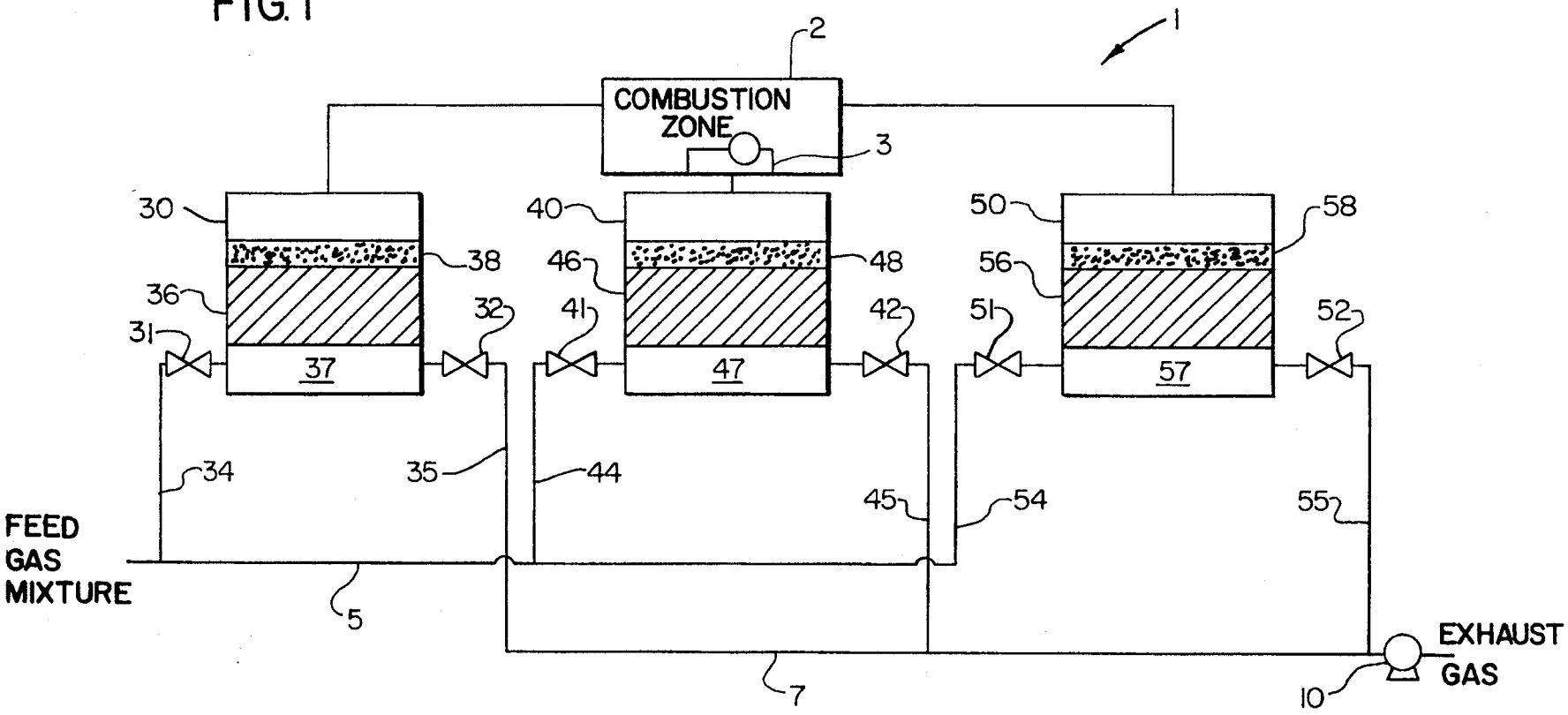
FIG. 1 schematically shows the process and apparatus of the present invention.

Referring now to FIG. 1, a regenerative incinerator in accordance with the present invention, generally designated by numeral 1, is schematically depicted. The incinerator 1 comprises a combustion zone 2 provided with a supplemental heat source 3 such as burners or electric heaters. The incinerator 1 further comprises an intake manifold 5 and an exhaust manifold 7. The feed gas mixture enters the incinerator 1 through intake manifold 5 and reacted gas is discharged to a recipient such as a storage vessel or a stack (not shown) through exhaust manifold 7. An exhaust blower 10 connected to exhaust manifold 7 pulls the gas through the incinerator 1.

The incinerator 1 further comprises three, separately-housed chambers 30, 40 and 50 in fluid communication with the combustion zone 2, the intake manifold 5 and the exhaust manifold 7. Associated with chambers 30, 40 and 50 are intake valves 31, 41 and 51 and exhaust valves 32, 42 and 52, respectively. While chamber 30, 40 or 50 is operating in the intake mode, intake valve 31, 41 or 51 allows feed gas mixture to flow from intake manifold 5 and enter the corresponding chamber via lines 34, 44 or 54, respectively. While chamber 30, 40 or 50 is operating in the exhaust mode, exhaust valves 32, 42 or 52 allows reacted gas to flow from the corresponding chamber to exhaust manifold 7 via lines 35, 45 or 55, respectively.

Each chamber 30, 40, and 50 contains a layer of heat exchange material 36, 46 and 56, respectively, disposed above a gas distribution/collection zone 37, 47 and 57, respectively. The heat exchange materials employed should be capable of withstanding process temperatures and pressures. Like the catalyst, the heat exchange material may be in particulate or monolithic form. If a particulate heat exchange material is employed, the particles may have any desired shape such as saddles, spheres, cylinders or Rachig rings and preferably have a nominal diameter between about 2 mm and 5 cm. The heat exchange material has an average heat capacity greater than 0.15 cal/cm$^3$, preferably greater than 0.2 cal/cm$^3$. Suitable heat exchange materials include ceramics such as $SiO_2$ and $Al_2O_3$, stoneware and mineral matter. Due to the relatively low operating temperatures, the heat content of the gas exiting the combustion zone 2 is reduced. Thus, a smaller quantity of heat exchange material may be used in the chambers 30, 40 and 50, thereby reducing the pressure drop across the incinerator 1. Alternatively, the quantity of heat exchange material may not be reduced in the incinerator 1 of the present invention so as to provide increased heat holding capacity and allow even longer heat cycle periods.

Each chamber 30, 40 and 50 further contains a catalyst layer 38, 48 and 58, respectively, as previously described. The catalyst layer 38, 48 and 58 is disposed such that when the chambers are being operated in the intake mode the feed gas mixture contacts heat exchange material before contacting the catalyst material. Operation of the heat source 3 is preferably controlled such that the operating temperature of the catalyst layers 38, 48 and 58 is greater than about 150° C. and less than about 700° C.

The process of the present invention employing a six-phase (phases A through F) heat cycle is now described.

In phase A, valves 31 and 42 are opened and valves 32, 41, 51 and 52 are closed so that chamber 30 is operated in the intake mode, chamber 40 is operated in the exhaust mode and chamber 50 is static. Feed gas mixture, typically at a temperature of 20° to 100° C., enters gas distribution/collection zone 37 of chamber 30. Distribution/collection zone 37 promotes relatively uniform flow of feed gas mixture through heat exchange layer 36. The feed gas is heated as it flows through heat exchange layer 36 and is substantially reacted in catalyst layer 38. The reacted gas then flows to combustion zone 2 which is operated at a temperature not in excess of 850° C., and preferably between 150° and 600° C., by operation of the supplemental heat source 3 as needed. Due to the relatively low operating temperatures, only a negligible amount of any combustible components remaining in the gas are oxidized in combustion zone 2. The gas then flows through chamber 40 where any remaining unreacted components of the feed gas are reacted in catalyst layer 48. As the gas flows through chamber 40, it transfers heat to catalyst layer 48 and heat exchange layer 46. The cooled gas then exists chamber 40 and flows via line 45 to exhaust manifold 7.

After heat exchange layer 36 is cooled to a preselected temperature, heat exchange layer 46 is heated to a preselected temperature, or a prescribed period of time elapses, gas flow through the incinerator 1 is redirected by closing valves 42 and opening valve 52 to initiate phase B of the cycle. Typically, the duration of phase A is between about 2 minutes and about 10 minutes, although longer or shorter periods may be employed.

In phase B, chamber 30 is operated in the intake mode, chamber 40 is static and chamber 50 is operated in the exhaust mode. Phase B is an intermediate step in the change-over of chamber 40 from the exhaust mode to the intake mode which allows gas to flow continuously through the incinerator 1 during the change-over without discharge of unreacted feed gas mixture from the incinerator 1 which may occur if valves 41 and 42 are repositioned simultaneously. Thus, the duration of phase B, typically 5 to 10 seconds, need only be long enough to reposition valve 42 to its closed position.

After valve 42 is closed, valve 41 is opened and valve 31 is closed to initiate phase C of the cycle. In phase C, chamber 30 is static, chamber 40 is operated in the intake mode and chamber 50 is operated in the exhaust mode. After heat exchange layer 46 is cooled to a preselected temperature, heat exchange layers 56 is heated to a preselected temperature, or a prescribed period of time elapses, phase D of the cycle is initiated by opening valve 32 and closing valve 52. Similar to phase B, phase D is an intermediate step in the change-over of chamber 50 from the exhaust mode to the intake mode.

After valve 52 is closed, valve 51 is opened and valve 41 is closed to initiate phase E of the cycle. During phase E, chamber 30 is operated in the exhaust mode, chamber 40 is static and chamber 50 is operated in the intake mode. After heat exchange layer 56 is cooled to a preselected temperature, heat exchange layer 36 is heated to a preselected temperature, or a prescribed period of time elapses, phase F, the final phase of the cycle, is initiated by opening valve 42 and closing valve 32. Similar to phases B and D, phase F is an intermediate step in the change-over of chamber 30 from the exhaust mode to the intake mode.

Once valve 32 is closed, a new heat cycle is initiated by opening valves 31 and closing valve 51. The position of the valves in each of the six phases of the process described above and typical phase times are summarized in Table I.

The heat cycle period in a process in accordance with the present invention is dependent upon several factors, including: the number of chambers in the incinerator, the amount of catalyst and heat exchange material disposed in the chambers, as well as the concentration and type of components found in the feed gas. Generally, however, due to the lower operating temperatures, the chambers of an incinerator operated in accordance with the present invention can be operated continuously in an intake or exhaust mode for a longer period of time than in a regenerative incinerator comprising chambers which do not contain catalyst material. As a result, the heat cycle period may be longer. Thus, the heat cycle period in the process of the present invention may be 1 to 60 minutes and is preferably 2 to 20 minutes.

Figure 2:
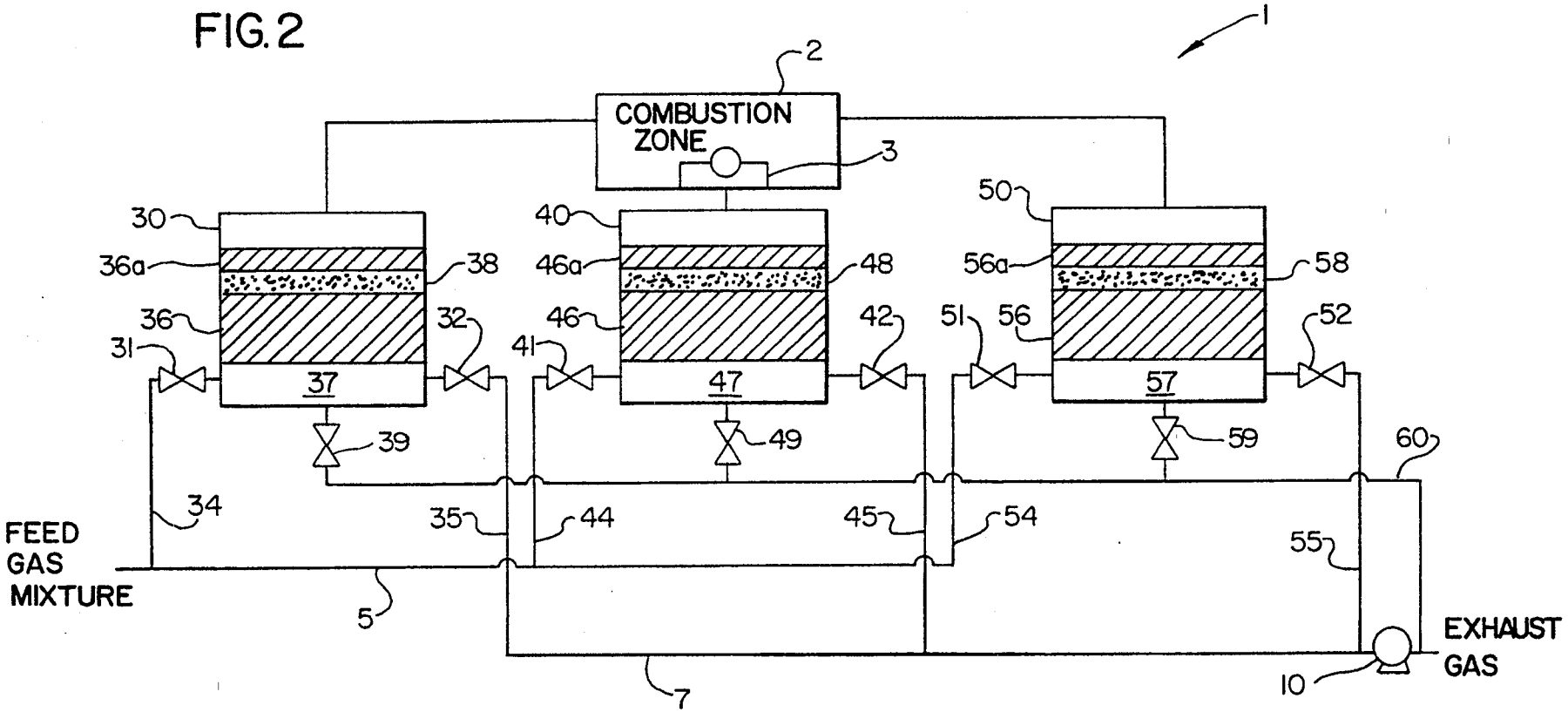
FIG. 2 schematically shows a further embodiment of the process and apparatus of the present invention.

It should be understood that the process and incinerator 1 previously described and shown in FIG. 1 may be modified in various ways without departing from the scope of the present invention. For example, phases B, D, and F of the operating cycle, although preferred, may be eliminated. Also, although the incinerator 1 comprises three chambers 30, 40 and 50, it should be understood that the present invention is equally applicable and provides similar advantages in an incinerator comprising additional chambers. Furthermore, as shown in FIG. 2, the chambers 30, 40 and 50 may contain a second layer of heat exchange material 36*a*, 46*a* and 56*a*, respectively, disposed such that the catalyst layers 38, 48 and 58 are interposed between two layers of heat exchange material. The second layer of heat exchange material inhibits rapid changes in the temperature of the catalyst material. Preferably, the change in temperature of the catalyst is less than 10° C./second and preferably less than 5° C./second. Furthermore, the second layer of heat exchange material is preferred when the operating temperature of the combustion zone exceeds 700° C. in order to protect the catalyst material from excessive heat.

The process of the present invention may be used in a regenerative incinerator in which the chambers are purged after being operated in an intake mode and before being operated in an exhaust mode. For example, as shown in FIG. 2, the incinerator 1 may further comprise purge valves 39, 49 and 59 associated with chambers 30, 40 and 50, respectively, and purge line 60. Purge valves 39, 49 and 59 allow purge gas from purge line 60 to enter the chambers during the purge mode. As shown in FIG. 2, the purge line 60 may be connected to exhaust manifold 7 so that the reacted gas exiting the incinerator 1 serves as the source of purge gas. The purge line 60 is connected to the exhaust manifold at a point relative to the exhaust blower 10 so as to provide a positive pressure in the purge line 60 relative to chambers 30, 40 and 50. If the process previously described and summarized in Table I is conducted in the incinerator shown in FIG. 2, chambers 50, 30 and 40 may be purged while in the static mode during phases A, C and E, respectively, by opening valves 59, 39 and 49, respectively, for a period of time sufficient to purge the chamber of unreacted gas prior to the start of the succeeding phase.

In a further embodiment of the process of the present invention, two or more chambers of a regenerative incinerator may be simultaneously operated in the intake or exhaust mode. By simultaneously operating two chambers in the intake or exhaust mode the pressure drop across the incinerator may be reduced, thereby decreasing energy requirements. If the catalytic reaction is exothermic, splitting the feed gas between two or more chambers operating in the intake mode provides a smaller temperature gradient and reduced operating temperature in the catalyst and heat exchange materials contained in the chambers. Furthermore, if the component concentration of the feed gas entering the incinerator is relatively high, simultaneously operating two or more chambers in the intake mode reduces the velocity of the gas as it passes through these chambers (as compared to operating a single chamber in the intake mode with the same gas loading), which may increase gas residence time in the chamber and provide greater catalytic conversion.

Therefore, with reference to the incinerator 1 shown in FIG. 1, the process of the present invention employing a three phase (phases A through C) heat cycle wherein two of the chambers 30, 40 or 50 are simultaneously operated in the intake mode is now described.

In phase A, valves 31, 41 and 52 are open and valves 32, 42 and 51 are closed so that chambers 30 and 40 are operated in the intake mode and chamber 50 is operated in the exhaust mode. In this manner the volumetric flow of feed gas entering the incinerator 1 is split between chambers 30 and 40 in substantially equal proportions. After heat exchange layer 36 or 46 is cooled to a preselected temperature, heat exchange layer 56 is heated to a preselected temperature, or a prescribed period of time elapses, gas flow through the incinerator 1 is redirected by opening valves 32 and 51 and closing valves 31 and 52 to initiate phase B of the cycle. During phase B the flow of feed gas entering the incinerator 1 is split between chambers 40 and 50 in substantially equal proportions and chamber 30 is operated in the exhaust mode. After heat exchange layer 46 or 56 is cooled to a preselected temperature, heat exchange layer 36 is heated to a preselected temperature, or a prescribed period of time elapses, gas flow through the incinerator 1 is redirected by opening valves 31 and 42 and closing valves 32 and 41 to initiate phase C of the cycle. Similarly, after heat exchange layer 36 or 56 is cooled to a preselected temperature, heat exchange layer 46 is heated to a preselected temperature, or a prescribed period of time elapses, gas flow through the incinerator 1 is again redirected by opening valves 41 and 52 and closing valves 42 and 51 to begin a new heat cycle. The position of the valves in each of the three phases of the process described above and typical phase times are summarized in Table II.

It should be understood that the process summarized in Table II could be modified to include intermediate phases in the change-over of a chamber from the intake mode to the exhaust mode so as to prevent unreacted feed gas mixture from being discharged from the incinerator 1 during the simultaneous stroking of an intake valve and an exhaust valve of the same chamber. The process could also be modified so that a chamber is purged after operation in the intake mode and before operation in the exhaust mode. As noted previously, the process of the present invention may also be adapted such that two or more chambers are simultaneously operated in the exhaust mode. Such a process is preferred when the component concentration of the feed gas is relatively low.

A variety of feed gas mixtures may be reacted in accordance with the process of the present invention. For example, the feed gas mixture may be an industrial or ventilation gas containing oxygen and a VOC or carbon monoxide (as described in U.S. Pat. No. 4,877,592), a sulphur dioxide and oxygen mixture (for the production of sulphur trioxide as described in U.S. Pat. No. 4,478,808), ammonia and $NO_x$ (for the reduction of nitrous oxides), $H_2S$ and $SO_2$ (for the production of sulfur) and methane and water (for the production of CO and $H_2$) or any other suitable gaseous mixtures which can be reacted in the presence of a catalyst.

The process of the present invention may be used in connection with endothermic and exothermic catalytic reactions. If the reaction is endothermic or if the feed gas mixture contains insufficient VOC content to maintain a high enough operating temperature to ensure sufficient catalytic activity, the supplemental heat source provided in the combustion zone is activated to add heat to the system to provide an adiabatic temperature rise in the gas. Typically, the adiabatic temperature rise should be between about 10° and 20° C., but may vary depending on catalyst activity and other parameters. Alternatively, a hydrocarbon fuel may be mixed with oxygen and the feed gas mixture to provide a sufficient operating temperature.

If the reaction is exothermic and the component content of the feed gas is relatively high, operation of the supplemental heat source 3 may be necessary only during start-up to initially heat the catalyst and heat exchange material.

It should be appreciated that the process and apparatus of the present invention are applicable to new installations as well as to retrofitting existing regenerative incinerators which do not comprise catalyst materials.

In view of the above, it will be seen that the several objects of the invention are achieved.

As various changes could be made in the above processes and apparatus without departing from the scope of the invention, it is intended that all matter contained in the above description be interpreted as illustrative and not in a limiting sense.

TABLE I

| PHASE | CHAMBER | DESCRIPTION- | Valve No. 31 | 32 | 41 | 42 | 51 | 52 | TIME |
|---|---|---|---|---|---|---|---|---|---|
| A | 30 | Intake | O | C | | | | | 2–10 |
| | 40 | Exhaust | | | C | O | | | min. |
| | 50 | Static | | | | | C | C | |
| B | 30 | Intake | O | C | | | | | 5–20 |
| | 40 | Static | | | C | C | | | sec. |
| | 50 | Exhaust | | | | | C | O | |
| C | 30 | Static | C | C | | | | | 2–10 |
| | 40 | Intake | | | O | C | | | min. |
| | 50 | Exhaust | | | | | C | O | |
| D | 30 | Exhaust | C | O | | | | | 5–20 |
| | 40 | Intake | | | O | C | | | sec. |
| | 50 | Static | | | | | C | C | |
| E | 30 | Exhaust | C | O | | | | | 2–10 |
| | 40 | Static | | | C | C | | | min. |
| | 50 | Intake | | | | | O | C | |
| F | 30 | Static | C | C | | | | | 5–20 |
| | 40 | Exhaust | | | C | O | | | sec. |
| | 50 | Intake | | | | | O | C | |

O: Open
C: Closed

TABLE II

| PHASE | CHAMBER | DESCRIPTION- | Valve No. 31 | 32 | 41 | 42 | 51 | 52 | TIME |
|---|---|---|---|---|---|---|---|---|---|
| A | 30 | Intake | O | C | | | | | 2–10 |
| | 40 | Intake | | | O | C | | | min. |
| | 50 | Exhaust | | | | | C | O | |
| B | 30 | Exhaust | C | O | | | | | 2–10 |
| | 40 | Intake | | | O | C | | | min. |
| | 50 | Intake | | | | | O | C | |
| C | 30 | Intake | O | C | | | | | 2–10 |
| | 40 | Exhaust | | | C | O | | | min. |
| | 50 | Intake | | | | | O | C | |

O: Open
C: Closed

What is claimed is:

1. In a process for gas phase reaction of a feed gas mixture in a regenerative incinerator, the incinerator comprising a combustion zone in fluid communication with at least three chambers, each chamber having a separate housing and containing a layer of solid heat exchange material, the chambers being in selective fluid communication with an inlet manifold and an exhaust manifold such that each chamber is selectively operable in an intake mode and an exhaust mode, each chamber having a layer of catalyst disposed therein, the amount of catalyst material disposed in each of the chambers being such that the ratio of the volume of catalyst material to the volumetric flowrate of feed gas mixture through the chamber when operating in the intake mode is between about 0.05 and about 2 seconds, the process comprising:

introducing the feed gas mixture into a selected one of the chambers when said selected chamber is operating in the intake mode;

flowing the feed gas through said selected chamber such that the feed gas contacts the layer of heat exchange material before contacting the layer of catalyst material, the feed gas being substantially reacted in said catalyst layer; and discharging the reacted gas from said selected chamber and into the combustion zone, the combustion zone being operated at a temperature not in excess of 850° C.

2. In a process for gas phase reaction of a feed gas mixture in a regenerative incinerator, the incinerator comprising a combustion zone in fluid communication with at least three chambers, each chamber having a separate housing and containing a layer of solid heat exchange material, the chambers being in selective fluid communication with an inlet manifold and an exhaust manifold such that each chamber is selectively operable in an intake mode and an exhaust mode, each chamber having a layer of catalyst disposed therein, the amount of catalyst material disposed in each of the chambers is such that the ratio of the volume of heat exchange material disposed in the chamber to the volume of catalyst material disposed in the chamber is between about 1 and about 50, the process comprising:

introducing the feed gas mixture into a selected one of the chambers when said selected chamber is operating in the intake mode;

flowing the feed gas through said selected chamber such that the feed gas contacts the layer of heat exchange material before contacting the layer of catalyst material, the feed gas being substantially reacted in said catalyst layer; and discharging the reacted gas from said selected chamber and into the combustion zone, the combustion zone being operated at a temperature not in excess of 850° C.

3. In a process for gas phase reaction of a feed gas mixture in a regenerative incinerator, the incinerator comprising a combustion zone having a supplemental heat source, the combustion zone being in fluid communication with at least three chambers, each chamber having a separate housing and containing a layer of solid heat exchange material, the chambers being in selective fluid communication with an inlet manifold and an exhaust manifold such that each chamber is selectively operable in an intake mode and an exhaust mode, each chamber having a layer of catalyst disposed therein, the process comprising:

introducing the feed gas mixture into a selected one of the chambers when said selected chamber is operating in the intake mode;

flowing the feed gas through said selected chamber such that the feed gas contacts the layer of heat exchange material before contacting the layer of catalyst material, the feed gas being substantially reacted in said catalyst layer;

discharging the reacted gas from said selected chamber and into the combustion zone, the combustion zone being operated at a temperature not in excess of 850° C.; and controlling operation of the supplemental heat source such that the operating temperature of the catalyst layers disposed in said chambers is greater than about 150° C. and less than about 700° C.

4. The process of claim 3 wherein the amount of catalyst material disposed in each of the chambers is such that the ratio of the volume of catalyst material to the volumetric flowrate of feed gas mixture through the chamber when operating in the intake mode is between about 0.05 and about 2 seconds.

5. A regenerative incinerator for gas phase reaction of a feed gas mixture comprising a combustion zone in fluid communication with at least three chambers, each chamber having a separate housing and containing a layer of solid heat exchange material, the chambers being in selective fluid communication with an inlet manifold and an exhaust manifold such that each chamber is selectively operable in an intake mode and an exhaust mode, the incinerator further comprising a layer of catalyst disposed in each chamber such that catalytic reaction of the feed gas mixture occurs and the operating temperature of the combustion zone is not in excess of 850° C., the layer of catalyst material being disposed in each chamber such that when the chambers are being operated in the intake mode the feed gas mixture flowing through the chambers contacts heat exchange material before contacting the catalyst material, the amount of catalyst material disposed in each of the chambers being such that the ratio of the volume of heat exchange material disposed in the chamber to the volume of catalyst material disposed in the chamber is between about 1 and about 50.

6. The process of claim 1 wherein the temperature of the catalyst material does not exceed about 700° C.

7. The process of claim 3 wherein the amount of catalyst material disposed in each of the chambers is such that the ratio of the volume of heat exchange material disposed in the chamber to the volume of catalyst material disposed in the chamber is between about 1 and about 50.

8. The process of claim 3 wherein the layer of catalyst material is interposed between two layers of heat exchange material.

9. The process of claim 8 wherein the rate of change in temperature of the catalyst material does not exceed 10° C./second.

10. The process of claim 3 wherein the operating temperature of the combustion zone is between 150° and 600° C.

11. The process of claim 3 wherein the heat cycle period is between 1 minute and 60 minutes.

12. The process of claim 3 wherein the catalyst is a monolithic honeycomb catalyst.

13. The process of claim 3 wherein a hydrocarbon fuel is mixed with the feed gas mixture entering the incinerator.

14. The process of claim 3 wherein the catalyst is a noble metal catalyst.

15. A regenerative incinerator for gas phase reaction of a feed gas mixture comprising a combustion zone in fluid communication with at least three chambers, each chamber having a separate housing and containing a layer of solid heat exchange material, the chambers being in selective fluid communication with an inlet manifold and an exhaust manifold such that each chamber is selectively operable in an intake mode and an exhaust mode, the incinerator further comprising a layer of catalyst disposed in each chamber such that catalytic reaction of the feed gas mixture occurs and the operating temperature of the combustion zone is not in excess of 850° C., the layer of catalyst material being disposed in each chamber such that when the chambers are being operated in the intake mode the feed gas mixture flowing through the chambers contacts heat exchange material before contacting the catalyst material, the amount of catalyst material disposed in each of the chambers being such that the ratio of the volume of catalyst material to the volumetric flowrate of feed gas mixture through the chamber when operating in the intake mode is between about 0.05 and about 2 seconds.

* * * * *